US005421572A

United States Patent [19]

MacKay, Jr.

[11] Patent Number: 5,421,572

[45] Date of Patent: Jun. 6, 1995

[54] FULL BARREL ALUMINUM BASEBALL BAT AND END CAP

[76] Inventor: Jack W. MacKay, Jr., Rte. 9, Box 185, Mt. Pleasant, Tex. 75455

[21] Appl. No.: 99,348

[22] Filed: Jul. 30, 1993

[51] Int. Cl.[6] ..... A63B 59/06

[52] U.S. Cl. ..... 273/72 A

[58] Field of Search ..... 273/72 R, 72 A, 26 B

[56] References Cited

U.S. PATENT DOCUMENTS

| | | | |
|---|---|---|---|
| 3,727,295 | 4/1973 | Gildemeister | 273/72 A |
| 3,779,551 | 12/1973 | Wilson | 273/72 A |
| 3,811,596 | 5/1974 | Wilson | 273/72 A |
| 3,861,682 | 1/1975 | Fujii | 273/72 A |
| 3,963,239 | 6/1976 | Fujii | 273/72 A |

FOREIGN PATENT DOCUMENTS

| | | | |
|---|---|---|---|
| 962291 | 2/1975 | Canada | 273/72 A |

*Primary Examiner*—Mark S. Graham

*Attorney, Agent, or Firm*—Jacobson, Price, Holman & Stern

[57] ABSTRACT

An aluminum baseball bat and end cap which has a full length barrel and a diameter greater than $2\frac{5}{8}$ inches in which the barrel is straight at its outer end rather than using a normally provided step down or end form currently being used which enables a $2\frac{5}{8}$ inch end cap to be used. In addition to the full barrel which includes a straight barrel or straight tube, a $2\frac{3}{4}$ inch end cap is installed in the end of the straight barrel or tube by telescoping a reduced diameter sleeve into the barrel with the sleeve having a ridge which locks into a groove in the inside of the barrel. This construction is incorporated into all barrel diameters in excess of $2\frac{5}{8}$ inches up to and including $2\frac{3}{4}$ inch diameter. This structure, in effect, lengthens the barrel bed and thus enhances the acceptable hitting area. The extended barrel length produced by the straight barrel or tube enhances the acceptable hitting zone by adding a flexible zone or trampoline effect with the end cap still providing the tube the necessary strength to withstand impact which was previously accommodated by the use of the crimped step down which was used for strength purposes.

2 Claims, 2 Drawing Sheets

FULL BARREL ALUMINUM BASEBALL BAT AND END CAP

BACKGROUND OF THE INVENTION

FIELD OF THE INVENTION

The present invention generally relates to baseball bats and more particularly an aluminum baseball bat and end cap which has a full length barrel and a diameter greater than 2⅝ inches in which the barrel is straight at its outer end rather than using a normally provided step down or end form currently being used which enables a 2⅝ inch end cap to be used. In addition to the full barrel which includes a straight barrel or straight tube, a 2¾ inch end cap is installed in the end of the straight barrel or tube by telescoping a reduced diameter sleeve into the barrel with the sleeve having a ridge which locks into a groove in the inside of the barrel. This construction is incorporated into all barrel diameters in excess of 2⅝ inches up to and including 2¾ inch diameter. This structure, in effect, lengthens the barrel bed and thus enhances the acceptable hitting area. The extended barrel length produced by the straight barrel or tube enhances the acceptable hitting zone by adding a flexible zone or trampoline effect with the end cap still providing the tube the necessary strength to withstand impact which was previously accommodated by the use of the crimped step down which was used for strength purposes.

DESCRIPTION OF THE PRIOR ART

Aluminum baseball bats have replaced conventional wood baseball bats, especially in the sub-professional area and has certain well known advantages as compared to wood bats. In the construction of presently available aluminum bats, when the diameter of the bat in the hitting area exceeds 2⅝ inches, the tubular end of the barrel of the aluminum bat is crimped and stepped down in order to enable a 2⅝ inch end cap to be used with the stepped down crimped area reinforcing the tubular end of the barrel and rigidifying the acceptable hitting area or zone to some extent. The additional rigidity provided by the step down crimped area rigidifies the over 2⅝ inch bat thus producing a hitting area or zone that does not obtain maximum velocity of a ball when hit by an existing bat over 2⅝ inch in diameter.

SUMMARY OF THE INVENTION

An object of the present invention is to provide an aluminum baseball bat utilizing a straight, tubular barrel having a diameter in excess of 2⅝ inches with the end of the straight barrel or tube receiving a unique 2¾ inch end cap with elimination of the step down crimp area enhancing the acceptable hitting area because the barrel bed is lengthened and because the extended barrel length adds a flexible zone or trampoline effect which further enhances the acceptable hitting zone and providing maximum velocity to a ball hit by the bat.

A further object of the invention is to provide an aluminum baseball bat in accordance with the preceding object in which the end cap is provided with reinforcing ribs and telescopingly engages the end of the straight barrel or straight tube in a manner that the end cap is securely locked to the barrel and provides the end of the barrel or tube with the necessary strength to withstand impact forces which the conventional crimped down end of the barrel or tube is provided with thereby providing sufficient strength to withstand the impact but at the same time provide an added length acceptable hitting area and the extended barrel length providing a flexible zone or trampoline effect thus enhancing the function of the acceptable hitting zone.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
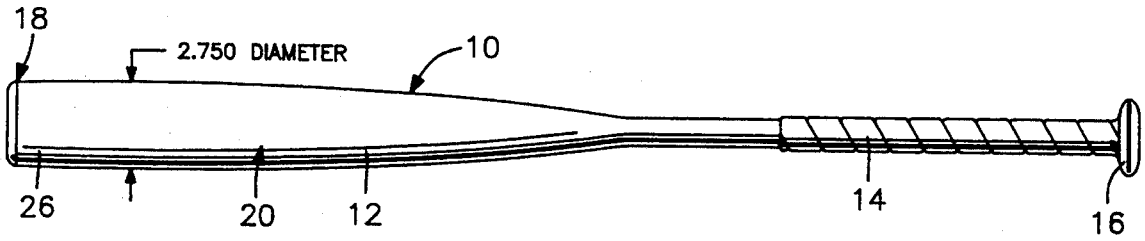
FIG. 1 is a side elevational view of an aluminum baseball bat constructed in accordance with the present invention.

Referring now specifically to FIG. 1, the aluminum bat of the present invention is generally designated by the reference numeral 10 and includes a tubular barrel 12, handle or hand grip area 14, a knob 16 at one end of the bat and an end cap 18 at the other end, Presently available aluminum baseball bats have this type of structure. However, in present day aluminum baseball bats, when the diameter of the outer end of the barrel 12 exceed 2⅝ inches, the tubular end of the barrel is crimped inwardly in order to receive a 2⅝ inch end cap. This step down or crimped inwardly end of the barrel produces a substantial additional rigidity to the aluminum bat in order to withstand the impact when the bat is used to hit a baseball in the acceptable hitting area generally designated by reference numeral 20.

In the present invention, the barrel 12 which, in the preferred embodiment, has a diameter of 2¾ inches but can be any diameter in excess of 2⅝ inch diameter and is generally straight on the interior and exterior from the outer end 26 which receives the end cap 18 with the interior surface of the barrel including an internal groove 27. The barrel may have tapered areas as is conventional.

Figure 2:
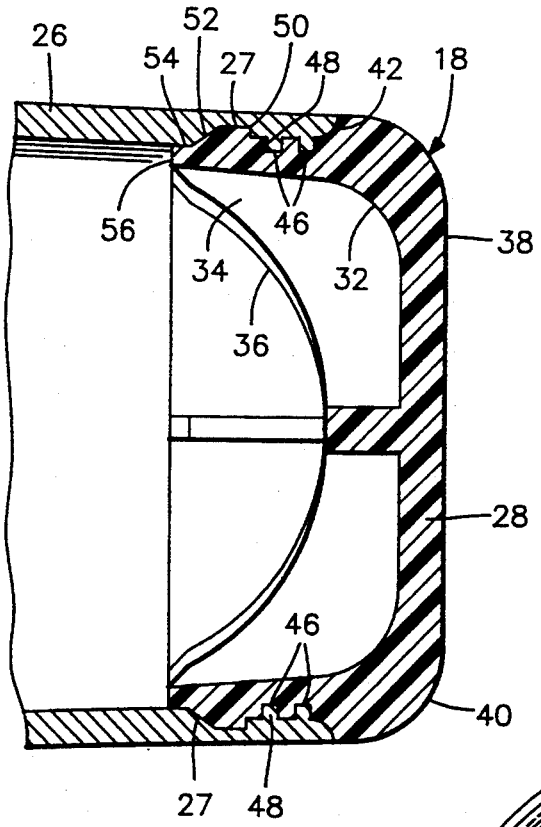
FIG. 2 is a side elevational view, with portions broken away of the end cap.
Figure 3:
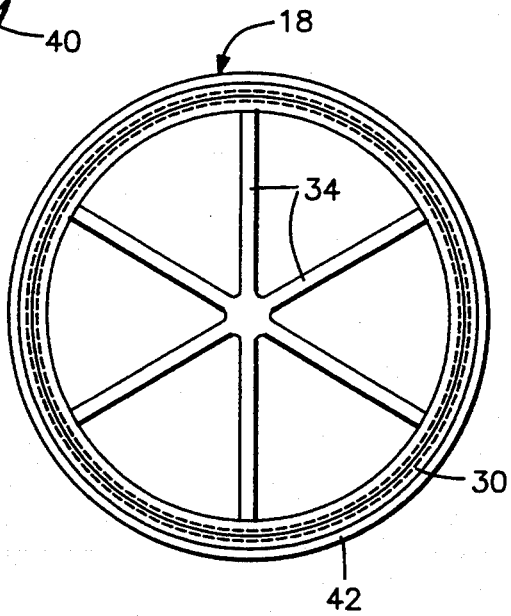
FIG. 3 is an elevational view of the inner end of the end cap illustrating the reinforcing ribs incorporated therein.

The end cap 18 is constructed of a plastic material, preferably polyurethane, and includes an outer end portion 28 which is solid and a sleeve 30 which telescopes into the end 26 of the straight barrel or tube 12. The interior of the cap 28 is concave or curved in a spherical manner as designated by reference numeral 32 and includes a plurality of ribs 34 which intersect at the center and are integral with the curved surface 32. The inner edge of each of the ribs 34 is also concave or arcuately curved as indicated by reference numeral 36 and is illustrated in FIGS. 2 and 3. The outer end portion 28 includes a generally flat surface 38 and an arcuately curved peripheral edge 40 with the arcuate edge 40 terminating in a radial shoulder 42 that extends inwardly and abuttingly engages the end edge of the end 26 of the barrel 12.

Figure 4:
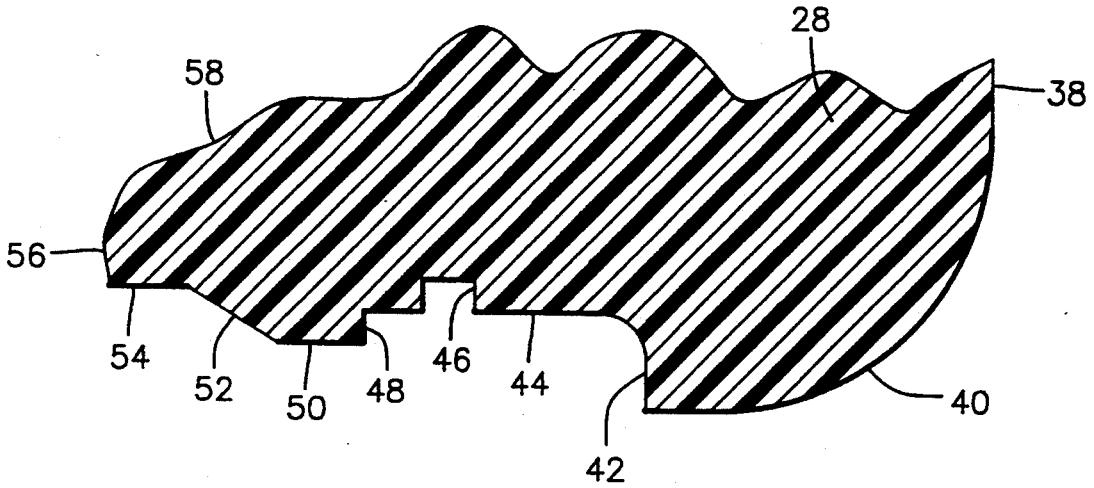
FIG. 4 is a fragmental sectional view on an enlarged scale illustrating the configuration of the outer periphery of the end cap.
Figure 5:
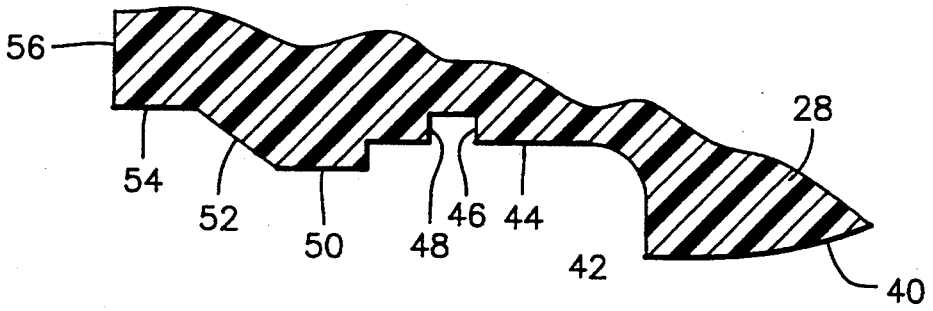
FIG. 5 is a further enlarged sectional view of the external surface of the end cap.
Figure 6:
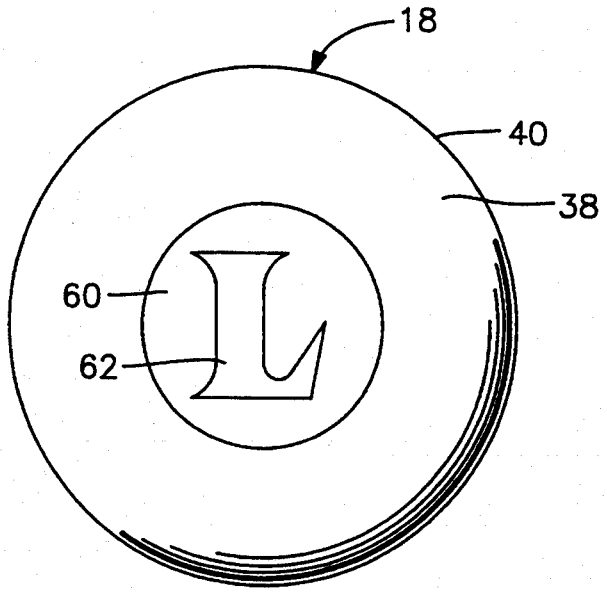
FIG. 6 is an end elevational view of the end cap from its outer end.

As illustrated in FIGS. 4 and 5, the periphery of the cap inwardly of the shoulder 42 includes a cylindrical portion 44 having a radially inwardly extending groove or grooves 46 therein with the inner end of the cylindrical portion 44 defining a shoulder 48 facing the shoulder 42 in spaced relation and extending a radial distance less than the shoulder 42. Extending inwardly from the shoulder 42 is a cylindrical portion 50 and an inwardly angled portion 52 terminating in a cylindrical portion 54 which enables the sleeve 30 to be inserted into and locked into the interior of the straight barrel or tube 12 by the shoulder 48 forming a locking ridge on the end cap entering the groove 27 in the interior of the bat barrel. The inner end of the sleeve 30 is radially straight as indicated by reference numeral 56 and the internal corner of the radially straight end portion 56 terminates in an inwardly angled portion 58 which together with groove 46 enhances the flexibility of the sleeve to enable it to be forced into the straight barrel or tube with an interference fit. The generally flat outer surface 38 of the cap is provided with a central cylindrical portion 60 providing an area for receiving a trademark, logo or other distinguishing indicia 62.

As indicated previously, the additional barrel length obtained when the step down crimped end is eliminated enhances the acceptable hitting area 20 due to the fact that the barrel is lengthened and the acceptable hitting area is lengthened. The extended barrel length adds a flexible zone or trampoline effect which enhances the function of the hitting zone. The end cap 18 with the reinforcing ribs 34 and the specific curved configuration of the interior of the cap and the interior of the ribs provides additional strength to the straight barrel or tube to withstand impact forces generated when the bat hits the ball with the added strength provided by the end cap compensating for the strength that would be normally provided by the crimped or step down end of the tube when forming a bat with a diameter in excess of $2\frac{5}{8}$ inches by crimping the end of the bat or stepping it inwardly sufficient to receive a $2\frac{5}{8}$ inch end cap on a tube or barrel that has a diameter greater than $2\frac{5}{8}$ inches. The end cap is assembled with the bat by the use of a force sufficient to move the ridge 48 into alignment with the groove 27 by deforming the ridge 48 as the sleeve is moved inwardly with the memory characteristics of the material causing the ridge 48 to securely lock into the groove 27. The end cap provides the additional strength to compensate for the additional length of the straight barrel or tube and the lack of a crimped end.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. An aluminum baseball bat comprising tubular barrel having a handle at one end and a full length hitting zone of constant diameter at the other end remote from the handle, said hitting zone having a constant external diameter in excess of $2\frac{5}{8}$ inches and up to and including $2\frac{3}{4}$ inches and being longitudinally straight and including continuous exterior and interior surfaces extending to the end remote from said handle, said interior surface of said barrel including a circular internal groove means formed in the aluminum defining the interior surface of said barrel, said groove means being positioned adjacent said end of the barrel remote from the handle and an end cap inserted into said barrel with the and cap including a short outer end portion having an external diameter substantially equal to the external diameter of the hitting zone of the barrel and a sleeve of reduced diameter projecting therefrom telescoped into the interior of the hitting zone of the barrel and having a peripheral ridge means spaced from said short outer end portion of said end cap, said ridge means projecting into said internal groove means in the interior surface of the remote end of the bat barrel for anchoring the end cap to the barrel, said end cap including internal reinforcing ribs to provide additional strength to the barrel, said continuous external surface of the hitting zone of the barrel providing additional length to the acceptable hitting zone of the bat.

2. The bat as defined in claim 1 wherein said end cap is of one-piece molded plastic material, said sleeve having a cup-shaped cavity in the inner end thereof, said reinforcing ribs extending radially from a center of the cavity to reinforce the cap.

* * * * *